United States Patent [19]

Nysten

[11] Patent Number: 5,003,673

[45] Date of Patent: Apr. 2, 1991

[54] SNAP FASTENER

[75] Inventor: Bernhard Nysten, Aachen, Fed. Rep. of Germany

[73] Assignee: William Prym-Werke GmbH. & Co. KG, Stolberg, Fed. Rep. of Germany

[21] Appl. No.: 533,424

[22] Filed: Jun. 5, 1990

[30] Foreign Application Priority Data

Jun. 6, 1989 [DE] Fed. Rep. of Germany ..... 3918375

[51] Int. Cl.[5] ..... A44B 17/00

[52] U.S. Cl. ..... 24/662; 24/681

[58] Field of Search ..... 24/662, 680, 681, 682, 24/689, 659

[56] References Cited

U.S. PATENT DOCUMENTS

| | | | |
|---|---|---|---|
| 573,532 | 12/1896 | Pringle | 24/681 |
| 2,975,803 | 8/1976 | Katayama | 24/689 |
| 4,541,558 | 9/1985 | Herten | 227/1 |
| 4,562,624 | 1/1986 | Kanzaka | 24/681 |
| 4,566,182 | 1/1986 | Altwicker | 29/715 |
| 4,596,349 | 6/1986 | Herten | 227/18 |
| 4,659,001 | 4/1987 | Herten | 227/153 |
| 4,703,882 | 11/1987 | Herten | 227/8 |
| 4,847,959 | 7/1989 | Shimada et al. | 24/681 |
| 4,851,883 | 1/1988 | Nysten | 24/681 |

*Primary Examiner*—Victor N. Sakran

*Attorney, Agent, or Firm*—Peter K. Kontler

[57] ABSTRACT

A snap fastener wherein the male and femal components are sealingly connected with sheet-like carriers of textile or other material. The male component has a male coupling element with a head which defines a cavity and with a collar one side of which is adjacent the inlet of the cavity. A deformable metallic or plastic liner is received in the cavity and has an extension in a depression at the one side of the collar. A first rivet secures the male coupling element to the outer side of a first carrier; to this, end, the shank of the rivet extends through the first carrier and into the liner to deform the latter into sealing engagement with the head as well as to urge the outer side of the first carrier against the extension of the liner. The female component has a female coupling element with a socket for the head of the male coupling element and a second rivet having a shank which extends through a second carrier and through a deformable washer which is thereby held in sealing engagement with the female coupling element. The washer is compressed between the inner side of the second carrier and a collar of the female coupling element. A plug of sealing material fills the hollow shank of the second rivet, and a ring of sealing material surrounds the shank of the second rivet and is biased against the outer side of the second carrier.

30 Claims, 5 Drawing Sheets

SNAP FASTENER

BACKGROUND OF THE INVENTION

The invention relates to snap fasteners in general, and more particularly to improvements in snap fasteners of the type wherein a male component having a male coupling element and a first rivet is repeatedly connectable to and disengageable from a female component having a female coupling element and a second rivet, wherein the first rivet serves to preferably permanently secure the male coupling element to a first carrier (such as a first piece of fabric) and wherein the second rivet serves to preferably permanently secure the female coupling element to a second carrier (such as a second piece of fabric).

Snap fasteners of the above outlined character are often utilized on garments, particularly in lieu of or in addition to customary buttons. If a snap fastener is to separably connect two overlapping pieces of fabric in a garment, the male coupling element is normally located at the outer side of the inner (overlapped) piece of fabric and is held in such position by the first rivet which extends through the inner piece of fabric. The female coupling element is located at the inner side of the outer (overlapping) piece of fabric and is held in such position by the second rivet which extends through the outer piece of fabric. This ensures that the so-called head of the male coupling element can be introduced into and releasably held in the complementary socket of the female coupling element. The rivets have shanks or shafts which extend through the respective pieces of fabric and are deformed in the respective coupling elements to establish a reliable (normally permanent) connection between the pieces of fabric and the associated coupling elements. The flange or base of the second rivet is exposed at the outer side of the outer piece of fabric, and the male coupling element is exposed at the outer side of the inner piece of fabric.

In the absence of a reliable seal between the flange of the second rivet and the outer fabric layer, wind and/or rain can penetrate through the outer piece of fabric where the shank of the second rivet extends through the outer piece of fabric. Analogously, wind and/or rain can penetrate through the inner piece of fabric in the region where the shank of the first rivet extends through the second piece of fabric. Reliable seals at locations where the shanks of the rivets extend through the respective pieces of fabric are particularly desirable when a snap fastener is used on a garment (such as a windbreaker jacket, a raincoat, a slicker, a jacket to be worn by a skier and many other types of outdoor garments and garments to be worn by sports persons) which is likely to be exposed to elements when in actual use. Many garments of the just outlined character embody so-called climatic membranes which overlie pieces of textile material and are impermeable to fluids. The outer layer (namely the membrane) of such twin-layer structure should prevent the penetration of wind and/or moisture but the inner layer should be free to "breathe".

It has been found hat the ability of the twin-layer structure to prevent penetration of wind and/or moisture is often destroyed at locations where the shanks of the rivets penetrate through the impermeable membranes. Attempts to seal the perforated portions of the membranes include the utilization of strips which are bonded (e.g., welded or adhesively secured) to the perforated portions of the membranes, normally at the inner sides of the respective pieces of fabric. The application of sealing strips is a time-consuming operation which contributes to the cost of the ultimate product, and the applied sealing strips detract from the appearance of the finished garment.

OBJECTS OF THE INVENTION

An object of the invention is to provide a novel and improved snap fastener which is constructed and which can be assembled in such a way that its components establish fluidtight seals in each region where the shanks of their rivets penetrate through carriers consisting of textile material or the like.

Another object of the invention is to provide a novel and improved male component for use as one half of the above outlined snap fastener.

A further object of the invention is to provide a novel and improved female component for use as the other half of the above outlined snap fastener.

An additional object of the invention is to provide novel and improved rivets for use in the above outlined components of the improved snap fastener.

Still another object of the invention is to provide a novel and improved method of sealing the regions where the shanks of rivets penetrate through pieces of fabric or other penetrable carriers for male and female components of snap fasteners.

A further object of the invention is to provide a snap fastener whose appearance is not affected by the fact that the regions where the rivets extend through the respective carriers are sealed against penetration of wind and/or moisture.

Another object of the invention is to provide a garment which utilizes snap fasteners of the above outlined character.

A further object of the invention is to provide a novel and improved male coupling element for use in the male component of the above outlined snap fastener.

An additional object of the invention is to provide a novel and improved female coupling element for use in the female component of the above outlined snap fastener.

Still another object of the invention is to provide novel and improved means for preventing penetration of wind and/or moisture through pieces of fabric which carry the components of the above outlined snap fastener.

An additional object of the invention is to provide a simple and inexpensive snap fastener which is particularly suitable for use in or on garments to be used by persons involved in outdoors activities and sports activities.

Another object of the invention is to provide a snap fastener which is constructed and assembled in such a way that it need not be utilized in conjunction with sealing strips even though it is capable of preventing penetration of wind and/or moisture through holes which are formed as a result of penetration of the shanks of its rivets through pieces of textile or other carrier material.

SUMMARY OF THE INVENTION

The invention resides in the provision of a snap fastener which comprises a male component including a male coupling element having an outer side, an inner side and a cavity with an inlet at the inner side. The male component further includes a first rivet having a deformable first shank extending into the cavity, and a liner (e.g., an elastically deformable plastic liner) at least a portion of which is disposed in the cavity between the male coupling element and the first shank. The snap fastener further comprises a female component including a female coupling element having a first side provided with a socket for the male coupling element and a second side provided with an opening which communicates with the socket. The female component of the improved snap fastener further comprises a second rivet having a deformable hollow second shank which extends into the socket by way of the opening, and sealing means including one or more sealing members, preferably a first sealing member in the form of a plug which is sealingly received in the second shank and a second sealing member in the form of a sealing ring surrounding the second shank.

The improved snap fastener can be attached to first and second carriers (e.g., pieces of textile material or twin layers including an outer layer of a material which is impermeable to fluids and an inner layer which is a piece of textile material) in the following way: A first side of the first carrier is adjacent the inner side of the male coupling element, the liner has an annular extension which abuts the first side of the first carrier, and the first rivet has a flange which abuts the second side of the first carrier opposite the extension of the liner. The first side of the second carrier is adjacent the second side of the female coupling element, and the second rivet has a flange which abuts the second side of the second carrier. The shank of the first rivet extends through the first carrier and the shank of the second rivet extends through the second carrier. The extension of the liner sealingly engages the first carrier in the region around the shank of the first rivet, and the ring of the sealing means sealingly engages the second carrier in the region around the shank of the second rivet.

The liner can be provided with a recess (e.g., a relatively shallow indentation or a through hole) for the shank of the first rivet. The shank of the hollow second rivet can be provided with an open end which is located in the socket when the second rivet properly connects the female coupling element to the second carrier.

The central portion of the flange of the first rivet is or can be integral with the respective shank, and the liner preferably surrounds the shank of the first rivet at least in the region of the central portion of such flange. This flange can be provided with an annular depression which confronts an annular 15 collar of the male coupling element. The extension of the liner can at least partially fill the depression of the flange.

The male coupling element includes a cupped portion or head which is receivable in the socket of the female coupling element, and the collar is integral with such cupped portion. The inner and outer sides are provided on the collar of the male coupling element, and a depression is provided at the inner side of the collar and communicates with the inlet of the cavity in the male coupling element. The extension of the liner extends from the cavity, through the inlet and into the depression at the inner side of the collar. The collar can be provided with a bent-over marginal portion which surrounds the depression in the inner side of the collar. The depth of the depression can equal or approximate the thickness of the extension. Furthermore the extension can at least substantially fill the depression, i.e., the outline of the external surface of the extension can match or approximate the outline of the internal surface of the collar bounding the depression in the inner side.

The liner and/or the plug and/or the ring can contain a solidified material, particularly a solidified elastomeric plastic material.

The liner can include an elastomeric protuberance which is inserted into the cavity and is held in the male coupling element by snap action preparatory to introduction of the shank of the first rivet.

The flange of the first rivet is or can be integral with the respective shank, and one side of this flange confronts the male coupling element. Such one side can be provided with a depression which surrounds the shank of the first rivet. The male component can further comprise an annular elastic washer which surrounds the first shank and preferably at least partially fills the depression of the flange.

The liner can comprise a hollow elastic protuberance which at least partially surrounds the shank of the first rivet in the cavity of the male coupling element, and the aforementioned normally washer-like extension is integral with the elastic protuberance and is confined between the flange of the first rivet and the collar of the male coupling element. The extension of the liner surrounds the shank of the first rivet. The hollow protuberance can include a round top wall and an annular wall which is thinner than the top wall and serves to connect the top wall with the extension. The male coupling element can comprise a ring-shaped constricting portion which surrounds a narrowed potion of the cavity at the inlet and has an inner diameter less than the diameter of the round top wall of the protuberance so that the top wall must undergo deformation during insertion into the cavity beyond the narrowed portion.

The shank of the first rivet is or can be hollow and can include a pointed tip which undergoes deformation as a result of introduction into the cavity to thereby urge a portion of the liner against the internal surface of the male coupling element.

An elastic washer can be provided between the female coupling element and the flange of the second rivet. The washer can be provided with at least one projection which extends, by snap action, into the socket by way of the opening and is outwardly adjacent the shank of the second rivet. The washer can include a centrally located dome which is integral with the at least one projection and is traversed by the shank of the second rivet. It is presently preferred to employ a washer having a substantially omega-shaped cross-sectional outline, and the dome of such washer can be provided with a recess which at least partially conforms to and receives a portion of the female coupling element. The at least one projection is provided in the recess.

The liner can contain a metallic material (such as copper or aluminum), and the shank of the first rivet can resemble or constitute a solid nail with a pointed tip. The at least partly metallic liner can be provided with a through passage for the shank of the first rivet, and such passage preferably includes a wider portion adjacent the inlet of the cavity and a narrower portion which is remote from the inlet and has a diameter less than that of the shank of the first rivet so that the liner undergoes deformation in the region of the second portion of the passage in response to forcible introduction of the shank of the first rivet. The liner can be provided with an internal bead which surrounds the narrower portion of the passage. A substantially cylindrical external surface of the at least partly metallic liner is preferably a tight friction fit in the cavity of the male coupling element.

The liner can at least substantially fill the cavity prior and subsequent to introduction of the shank of the first rivet into the cavity. This liner can be provided with a centering recess for the shank of the first rivet in the region of the inner side of the collar of the male coupling element. That surface of the liner which faces away from the inlet of the cavity can be provided with a recess which at least partially disappears in response to introduction of the shank of the first rivet into the cavity.

The novel features which are considered as characteristic of the invention are set forth in particular in the appended claims. The improved snap fastener itself, however, both as to its construction and the mode of assembling the same, together with additional important features and advantages thereof, will be best understood upon perusal of the following detailed description of certain presently preferred specific embodiments with reference to the accompanying drawing.

DESCRIPTION OF THE PREFERRED EMBODIMENTS

Figure 1:
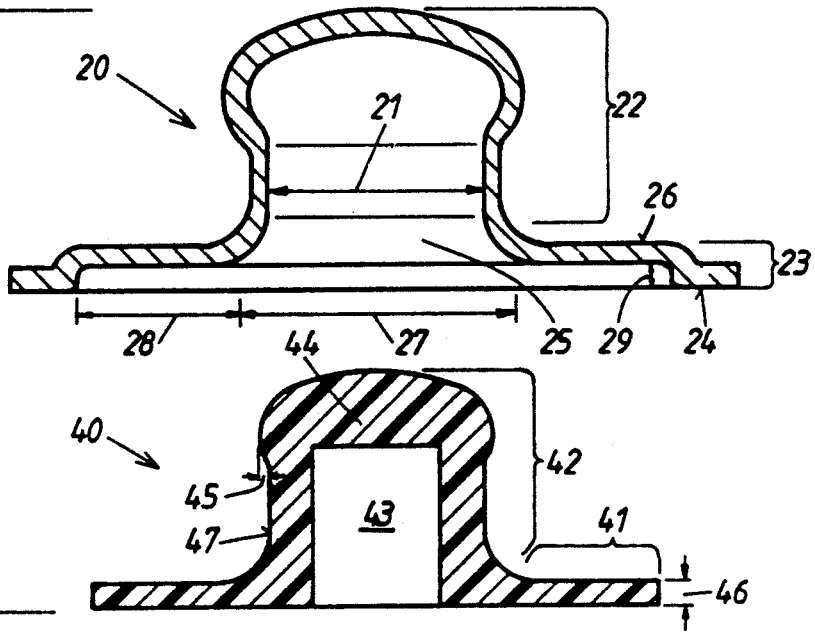
FIG. 1 is a central sectional view of a male coupling element and a central sectional view of a liner which can be assembled with the male coupling element into the male component of a snap fastener embodying one form of the invention.

FIG. 1 shows two parts of the male component of a snap fastener which embodies one form of the present invention. These parts include a male coupling element 20 which is made of a metallic sheet material and an elastically deformable insert or liner 40 (hereinafter called liner) which has a hollow protuberance 42 receivable by snap action in a complementary cavity 25 of the male coupling element 20. The male coupling element 20 comprises a substantially flat washer-like circular portion 23 (hereinafter called collar) which is integral with the open end of a hollow cup-shaped portion or head 22 and has a first (inner) side 24 and a second (outer) side 26. The inner side 24 is flat and is provided with a shallow annular depression 29 surrounding and communicating with the inlet of the cavity 25.

The protuberance 42 of the liner 40 has a rounded top wall 44 and an annular wall 47 which connects the top wall 44 with a flat washer-like annular extension 41 of the liner. The thickness (46) of the extension 41 matches or approximates the depth of the depression 29 in the inner side 24 of the collar 23, and the thickness of the annular wall 47 is less than the thickness of the top wall 44. The reference character 45 denotes a gradual transition between one end of the annular wall 47 and the adjacent marginal portion of the top wall 44. The annular wall 47 surrounds a blind hole or recess 43 which is or can be surrounded by a substantially cylindrical internal surface of the liner 40. The maximum diameter of the top wall 44 exceeds the diameter (21) of that portion of the cavity 25 which is adjacent the inlet (i.e., the inner side 24 of the collar 23) so that, when the top wall 44 is introduced into the cavity 25 to assume the position which is shown in the upper half of FIG. 2, the top wall must undergo a certain amount of deformation prior to rapidly expanding and snapping into the enlarged deepmost portion of the cavity. The fully inserted top wall 44 need not completely fill the deepmost portion of the cavity 25, at least during that stage of assembly of the male component which is shown in the upper portion of FIG. 2. At such time, the extension 41 is received in and at least substantially fills the depression 29 in the inner side 24 of the collar 23, and the annular wall 47 is surrounded by the neckshaped (smaller-diameter) portion of the hollow head 22 of the male coupling element 20. The radial dimension (28) of the depression 29 can match or approximate the radial dimension of the extension 41, i.e., the surface bounding the depression 29 can be said to conform to adjacent portion of external surface of the extension 41. The reference character 27 denotes the maximum diameter of the inlet of the cavity 25; this diameter preferably exceeds that of the rounded top wall 44 to permit convenient and effortless introduction of the top wall 44 into the cavity preparatory to deformation of the top wall for advancement through the neck portion of the head 22. When the male coupling element 20 and the liner 40 are assembled into a unit 60 which is shown in FIG. 2, the symmetry axis of the element 20 coincides with the symmetry axis of the liner.

Figure 2:
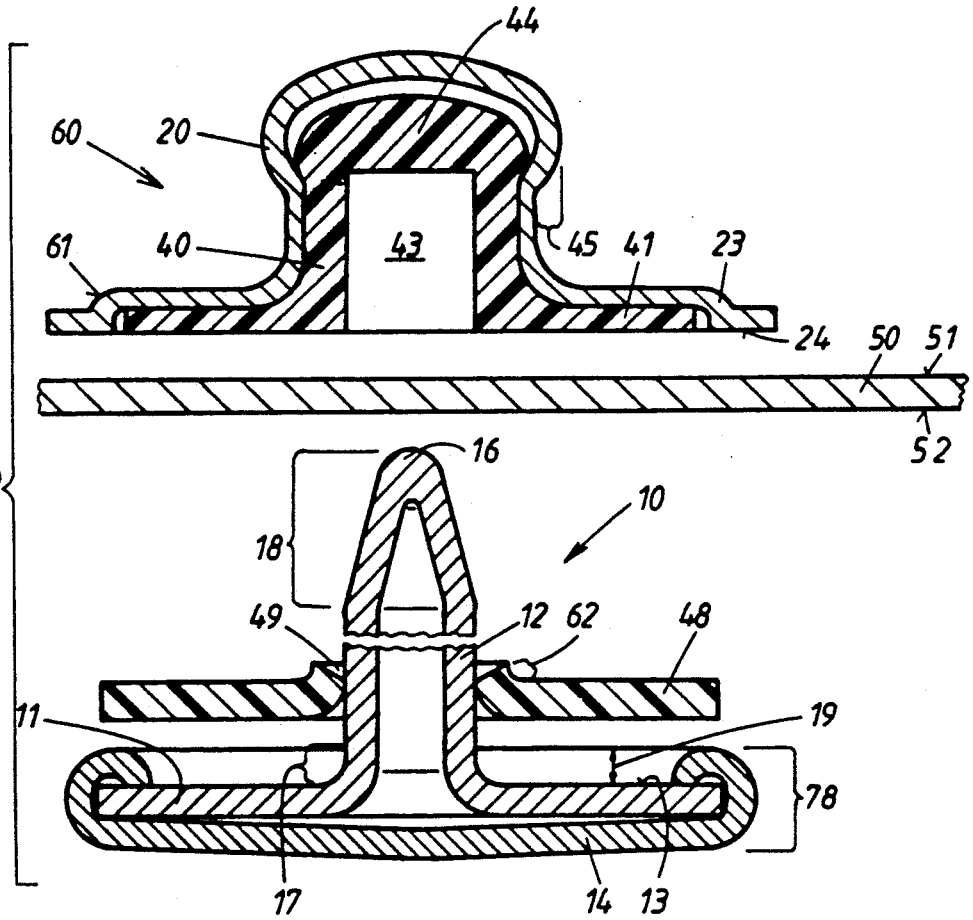
FIG. 2 is a central sectional view of the assembled male coupling element and liner and a central sectional view of a rivet which can be used to secure the male coupling element to one side of a sheet-like first carrier between a washer-like extension of the liner and an annular elastic washer for the rivet.

The material of the liner 40 is preferably a synthetic plastic substance which exhibits at least some elasticity so that its top wall 44 can undergo deformation during introduction into the deepmost portion of the cavity 25 and that its walls 44 and 47 can undergo deformation during introduction (into the recess 43) of a deformable hollow stem or shank 12 of a composite rivet 10 shown in FIG. 2 and constituting a third part of male component of the snap fastener The male component of FIGS. 1 and 2 further comprises an annular elastic washer 48 which can be made of the same material as the liner 40 and serves to surround the root portion of the shank 12 as well as to at least substantially fill an annular depression 19 at that (inner) side of a composite flange 78 of the rivet 10 from which the shank 12 extends.

The shank 12 has a somewhat pointed tip 16 forming the outermost part of a hollow conical end portion 18 of the shank. The lower portion of the shank 12 (as seen in FIG. 2) is integral with a disc 11 which constitutes one portion of the flange 78 and has a marginal portion confined in the bent-over marginal portion of a slightly concavo-convex cap 14 constituting the other part of the flange 78.

The depth of the depression 19 of the flange 78 can equal or approximate the thickness of the washer 48 which has a central opening 49 for the shank 12 and is at least slightly deformed (as at 62) in response to insertion of the cylindrical portion of the shank into the opening 49. When the unit 60 (including the male coupling element 20 and the liner 40) is properly assembled with the rivet 10 and with the washer 48, the washer is biased against the surface 13 of the disc 11 in the depression 19 and the central portion of the washer sealingly engages the shank 12 in the region (at 17) where the shank 12 merges into the disc 11. The fully assembled male component (10+20+40+48) of the snap fastener is shown in FIG. 4. The assembling step involves simultaneous attachment of the male component to a flexible sheet-like carrier 50 (shown in FIGS. 2 and 3) having a first side 51 which is sealingly engaged by the extension 41 of the liner 40 and a second side 52 which is sealingly engaged by the washer 48. This ensures that air and/or moisture cannot penetrate through the hole 150 which is made by the shank 12 of the rivet 10 prior to entry of the shank 12 into the recess 43 of the liner 40 in the unit 60.

The shank 12 undergoes a certain amount of deformation during penetration into the liner 40 of the unit 60, and such deformation is attributable primarily to impingement of the tip 16 upon the internal surface 53 at the center of the head 22 (see FIG. 4). The tip 16 penetrates through the top wall 44 of the liner 40 to bear directly upon the head 22 and to displace the material of the liner in order to at least substantially fill the cavity 25 with elastomeric material. This reliably ensures that wind and/or moisture (denoted by arrows 55 in FIG. 4) cannot penetrate into the head 22 when the tip 16 is adequately deformed so that the conical end portion 18 of the shank 12 is converted into a substantially cupola-shaped body 18'' shown in FIG. 4. The side 51 is the exposed side of the carrier 50, and the latter is normally overlapped by a second sheet-like carrier 50' (shown in FIGS. 5 and 6) which is connected with the female component of the snap fastener.

As can be seen in FIG. 4, the extent of deformation of extension 41 in the assembled male component need not be so pronounced that the extension fills the entire depression 29 at the inner side 24 of the collar 23, i.e., the diameter of the extension 41 need not increase to such an extent that the marginal portion of the extension reaches all the way to and sealingly engages the stepped marginal portion 61 of the collar 23. The configuration of the marginal portion 61 of the collar 23 is preferably selected in such a way that the male coupling element 20 can be readily manipulated by available machines which are used for the application of male and female components of snap fasteners to articles of clothing and the like. Reference may be had to commonly owned U.S. Pats. Nos. 4,596,349 (granted June 24, 1986 to Herten), 4,541,558 (granted Sept. 17, 1985 to Herten et al.), 4,566,182 (granted Jan. 28, 1986 to Altwicker et al.), 4,659,001 (granted Apr. 21, 1987 to Herten) and 4,703,882 (granted Nov. 3, 1987 to Herten) which show machines (known as riveting presses) serving to apply components of snap fasteners or other hardware to garments and the like. Certain types of snap fasteners capable of being manipulated in the machines which are described in the above-enumerated patents are described and shown in commonly owned U.S. Pat. No. 4,751,773 granted Jan. 21, 1988 to Nysten. The patented machines can treat the unit 60 as a one-piece part which is ready to be coupled with the rivet 10 and washer 48 and to be simultaneously secured to the outer side 51 of the carrier 50.

The rivet 10 has a circular outline, the same as the washer 48, and the common axis of the rivet 10 and washer 48 coincides with the axis of the unit 60 when the male component of the improved snap fastener is fully assembled and is also sealingly secured to the carrier 50.

The illustrated flange 78 of the rivet 10 can be modified in a number of ways without departing from the spirit of the invention. For example, the cap 14 can be omitted if the disc 11 is shaped in such a way that it defines a depression (corresponding to the depression 19 of FIG. 2) for the washer 48. The shape of the disc 11 then resembles that of the collar 23. The washer 48 constitutes a desirable but optional part of the male component because this washer is located at the inner side 52 of the carrier 50, i.e., its sealing engagement with the side 52 and with the surface 13 at the bottom of the depression 19 is not absolutely necessary since the deformed liner 40 cooperates with the male coupling element 20 and with the carrier 50 to reliably seal the hole 150 at the outer side 51 of the carrier.

The opening 49 in the central portion of the washer 48 need not be a prefabricated hole, i.e., such opening can be made by the shank 12 prior to penetration of the tip 16 through the carrier 50 and thereupon into the recess 43 of the liner 40 in the unit 60. However, it is equally within the purview of the invention to employ a genuine washer 48, i.e., a washer which is furnished with a prefabricated centrally located opening or hole 49 for the shank 12 of the rivet 10. The diameter of the prefabricated hole or opening 49 can be slightly smaller than the outer diameter of the cylindrical portion of the hollow shank 12 so that the central portion of the washer 48 is deformed (at 62) while it is being slipped onto the shank 12.

The aforediscussed patented riveting presses of the assignee of the present application are provided with suitable means for properly aligning successive rivets 10 with successive units 60 preparatory to penetration of shanks 12 through the carrier 50 and into the recesses 43 of the aligned units 60. While a shank 12 undergoes deformation as a result of penetration through the top wall 44 of the liner 40 and particularly as a result of subsequent engagement with the internal surface 53 of the head 22, the external surface of the head 22 is confined in a complementary socket (not shown) provided in a highly deformationresistant member of the riveting press (such member can be made of hardened steel) so that the configuration of the head 22 remains unchanged. This is desirable since the head 22 must be capable of repeatedly entering and exiting a socket 36 (FIG. 5) in a female coupling element 30 of the female component of the snap fastener. The deformed liner 40 in the cavity 25 of the male coupling element 20 establishes a highly reliable mechanical connection between the element 20 and the rivet 10; at the same time, the deformed liner 40 prevents the penetration of wind and/or moisture along the outer side 51 and toward the hole 150 of the carrier 50 when the assembly of the unit 60 with the rivet 10 and washer 48 is completed. FIG. 4 shows that the central portion of the extension 41 can actually penetrate into the hole 150 to bear upon the adjacent beadlike portion 62 of the washer 48 and to thus even further reduce the likelihood of penetration of wind and/or moisture along the internal surface 24 of the collar 23 (as at 56 in FIG. 4), thereupon between the extension 41 and the outer side 51, thereupon through the hole 150, and finally between the strongly deformed washer 48 and the inner side 52 of the carrier 50 to reach that portion of the inner side 52 which surrounds the cap 14 and the marginal portion of the deformed washer 48.

It has been found that, in many or most instances, the wind and/or moisture (arrows 55 in FIG. 4) cannot even penetrate beyond the portion 56 of the outer side 51 and much less all the way along the deformed extension 41 on toward the hole 150. The sealing action between the deformed extension 41 and the surface at the bottom of the depression 29 is equally satisfactory, i.e., neither wind nor moisture can penetrate into the hollow head 22 of the male coupling element 20 toward the tip of deformed end portion 18'' of the shank 12 in the cavity 25. In fact, even if the wind and/or moisture were free to penetrate all the way to the deformed end portion 18', this would still prevent gaseous and/or hydraulic fluid from entering the space at the inner side 52 of the carrier 50 because the deformed end portion 18' of the shank 12 continues to remain closed, i.e., the internal space 15 of the shank 12 is sealed from the cavity 25.

The extension 41 of the liner 40 cooperates with the washer 48 to prevent leakage of fluids along the adjacent portions of inner and outer sides 52, 51 of clamped portion of the carrier 50, namely the flow of fluids from the portion 56 of the outer side 51 toward the hole 150 as well as from the hole 150 toward the marginal portion of the washer 48. In addition, the extension 41 cooperates with the washer 48 to fluidtightly seal any cracks, bores, holes, rips or tears in the carrier 50 anywhere within the confines of marginal portions of the extension 41 and washer 48. For example, the extension 41 will cooperate with the washer 48 to reliably seal any cracks which extend radially from the hole 150 if such cracks develop as a result of forcible penetration of the tip 18 of the shank 12 through the carrier 50 on its way into the recess 43 of the liner 40 in the unit 60.

The sealing action of the deformed washer 48 is especially pronounced at the root of the shank 12, i.e., in the region 17 of the external surface of the shank. As mentioned above, and as shown in FIG. 4, the deformed radially innermost portion of the extension 41 can actually reach and sealingly engage the radially innermost portion 62 of the washer 48 so that the liner 40 and the washer 48 can be said to constitute a composite seal which extends along both sides of the carrier 50, into the hole 150, along the external surface of the shank 12 and along the internal surface of the head 22. The carrier portion around the hole 150 is subjected to a very pronounced clamping, pinching or squeezing action which also contributes to the establishment of a highly reliable seal all the way around the hole 150. The bent-over marginal portion 57 of the cap 14 subjects the marginal portion of the washer 48 to a very pronounced deforming action (this can be readily seen in FIG. 4) to even further reduce the likelihood of penetration of gaseous and/or hydraulic fluids radially outwardly beyond the washer 48. At the same time, the marginal portion 57 of the cap 14 (indirectly) biases the adjacent portion of the carrier 50 against the stepped marginal portion 61 of the metallic collar 23 to even further reduce the likelihood of penetration of any fluids along the outer side 51 of the carrier and toward the fully confined extension 41 of the liner 40.

Figure 3:
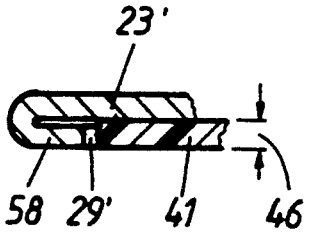
FIG. 3 is a fragmentary central sectional view of a modified male coupling element and of the extension of the liner.
Figure 4:
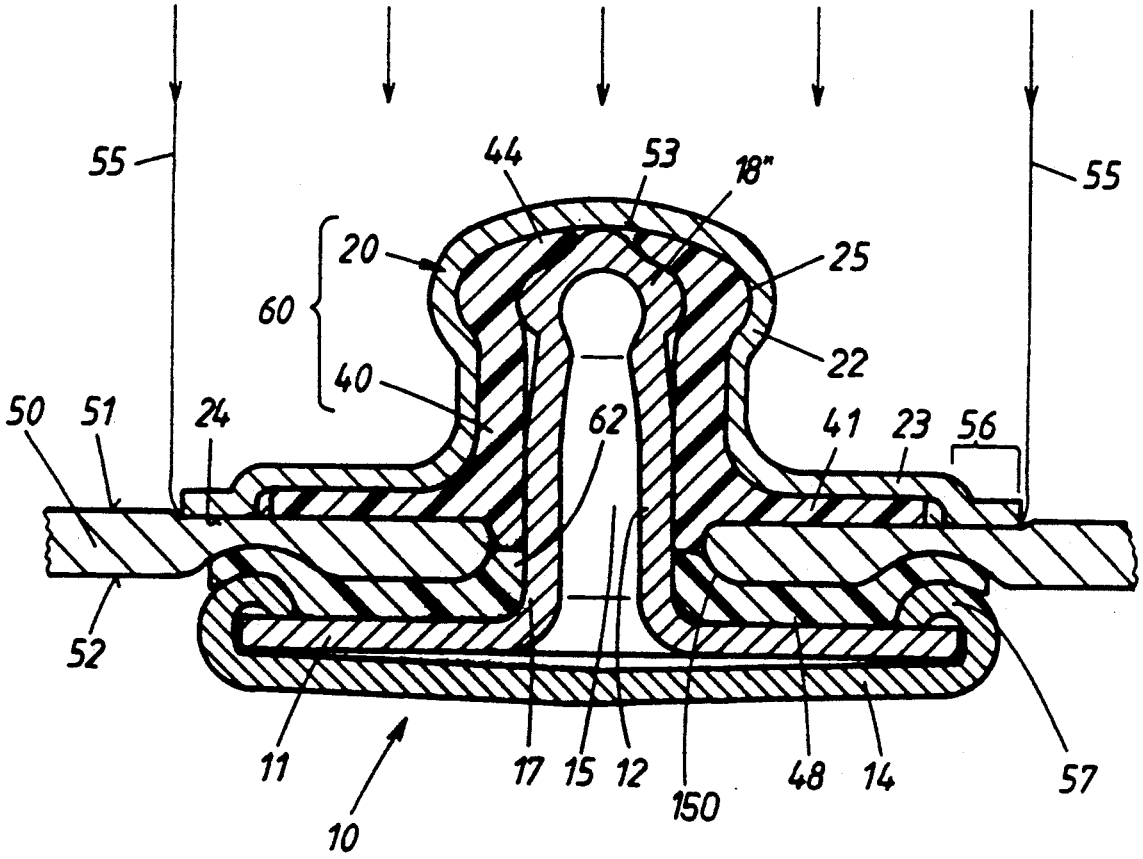
FIG. 4 is a central sectional view of the assembled male component, with the male coupling element located at one side and the flange of the rivet located at the other side of the carrier which is traversed by the shank of the rivet.

FIG. 3 shows a portion of a modified unit including a male coupling element with a collar 23' and a liner having an extension 41. The marginal portion 58 is bent over the adjacent portion of the inner side of the collar 23' to form an annular depression 29' having a depth 46 which equals or approximates the thickness of the extension 41. In other words, the stepped marginal portion 61 of the collar 23 is replaced with the marginal portion 58 which is bent through an angle of at least close to 180°. In all other respects, the unit including the structure of FIG. 3 is or can be identical with the unit 60 of FIGS. 2 and 4.

Figure 5:
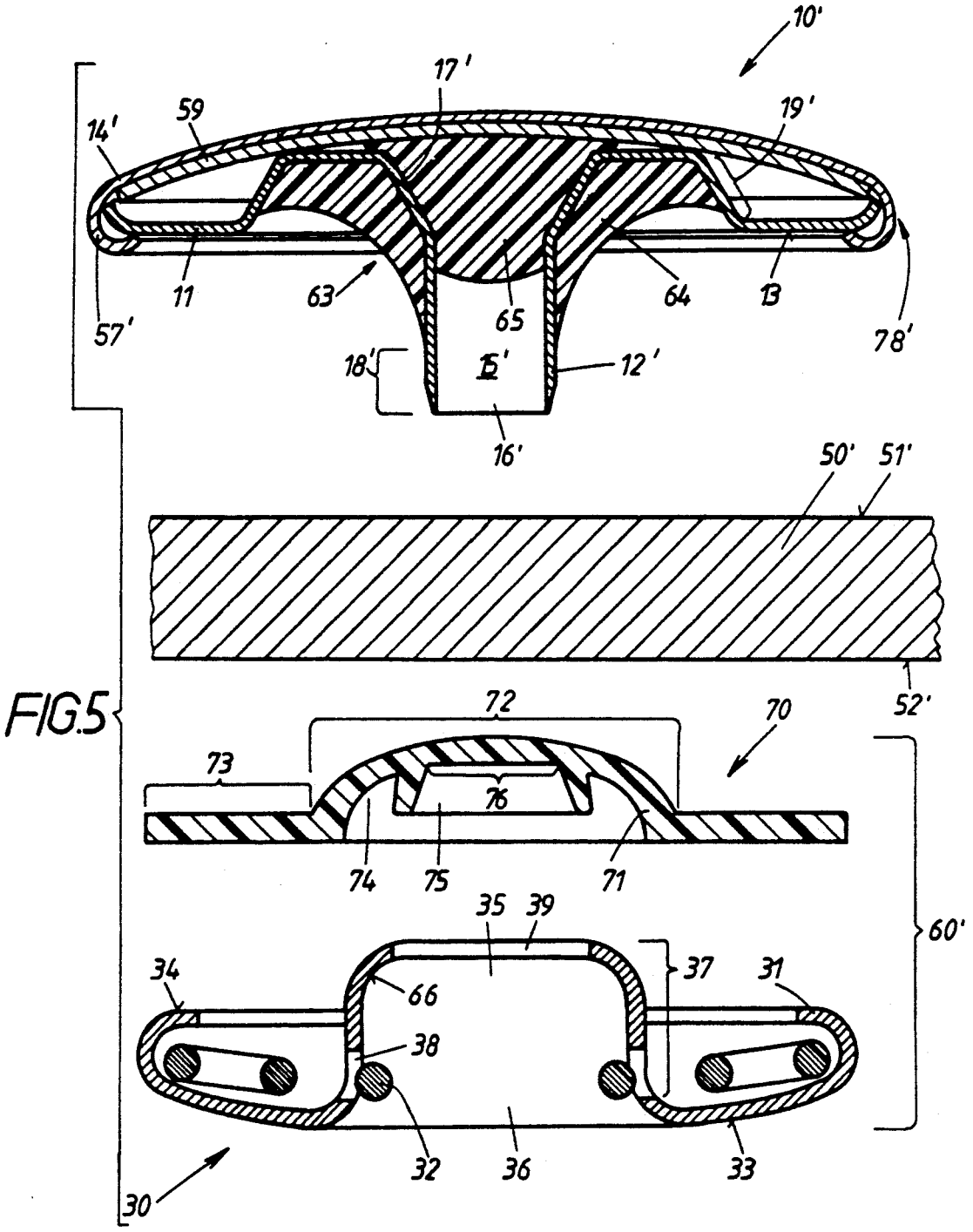
FIG. 5 is an exploded central sectional view of a female component which can be used with the male component of FIG. 4, the rivet of the female component being located at one side and the female coupling element and a washer of the female component being located at the other side of a second sheet-like carrier.
Figure 6:
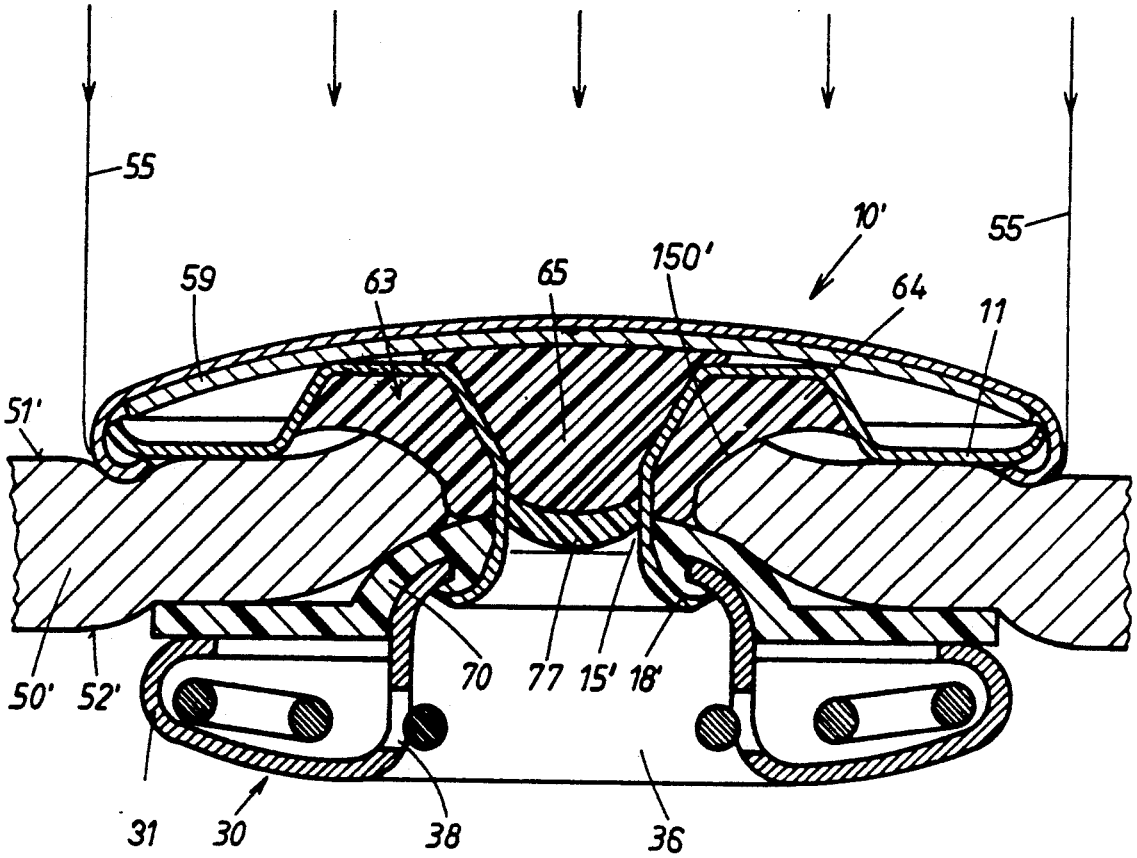
FIG. 6 is a central sectional view of the assembled female component, with the shank of the rivet extending through the second carrier.

Instead of employing a prefabricated liner 40, it is equally within the purview of the invention to at least partially fill the cavity 25 and the depression 29 or 29' of the male coupling element 20 with a liquefied sealing material, particularly a suitable plastic material, which is thereupon caused or allowed to set and to form a liner which resembles, or is at least a functional equivalent of, the liner 40. The liquefied material of the liner 40 can be applied by dipping, spraying or casting. A similar procedure can be resorted to for the making of sealing members 64, 65 which are shown in FIGS. 5 and 6 and are combined with a rivet 10' forming part of the female component of the improved snap fastener. In fact, the sealing members 64, 65 of FIGS. 5 and 6 are obtained by causing or permitting a liquefied sealing material to set prior to attachment of the rivet 10' to the carrier 50' and female coupling element 30 of the female component of the snap fastener.

The rivet 10' of the female component has a hollow shank or shaft 12' which has an end portion 18' provided with an open end 16'. Thus, the space 15 within the hollow shank 12' is free to communicate with the atmosphere and is free to receive flowable sealing material which is to form the sealing member 65 (hereinafter called plug for short). The sealing member 64 is a ring which surrounds the hollow shank 12' of the rivet 10'.

The flange 78' of the rivet 10' comprises a 35 cap 14' with a marginal portion 57' which is bent over the marginal portion of a different (profiled) disc 11' of the flange 78'. The flange 78' is reinforced by a concavo-convex disc-shaped insert 59 between the disc 11' and the cap 14'. The insert 59 is centered by the marginal portion 57' and/or by the adjacent marginal portion of the disc 11'. That portion (17') of the shank 12' which is located between the plug 65 and the ring 64 of the sealing means 63 on the rivet 10' constitutes or resembles a hollow conical frustum. The end portion 18' of the shank 12' is or resembles a hollow cylinder, the portion 17' is a conical frustum, and the disc 11' further includes a flat washer-like portion between the frustoconical portion 17' and a further frustoconical portion 19' followed by a surrounding flat washer-like portion with a suitably bent rim to be engaged by the marginal portion 57' and to center the insert 59.

As mentioned above, the sealing means 63 including the plug 65 and the ring 64 is applied in liquefied state and is caused or permitted to set in order to form a composite seal within as well as around a substantial portion of the shank 12' and at both sides of a substantial portion of the disc 11'. The originally liquefied material of the sealing means 63 is a synthetic rubber or any other substance which exhibits a requisite amount of elasticity and sets to form sealing members of desired size and shape.

The female coupling element 30 of the female component of the improved snap fastener is made of a metallic sheet material (e.g., the same material as the male coupling element 20), and can be assembled into a unit 60' with a prefabricated elastic washer 70 before the washer is pierced by the end portion 18' of the shank 12'. Such piercing of a centrally located dome-shaped portion 71 of the washer 70 is preceded by penetration of the open end 16' of end portion 18' through the second carrier 50'. The washer 70 has a substantially omega-shaped cross-sectional outline and its dome 71 defines a recess 74 bounded by a concave surface substantially conforming to adjacent portion at the inner side 34 of the metallic female coupling element 30. The recess 74 contains an annular projection 75 which is integral with the dome 71 and can be replaced with an annulus of discrete projections. The purpose of the illustrated projection 75 is to couple the dome 71 to the adjacent portion of the female coupling element 30 in order to assemble the parts 30, 70 into the aforementioned unit 60' which is then ready to be affixed to the carrier 50' by the rivet 10'. The annular portion 73 of the washer 70 around the dome 71 is or can be flat. The projection 75 is a relatively short conical frustum the inner diameter of which increases from a minimum value 76 at the apex of the dome 71 to a maximum value at the open end of the projection.

The collar 31 of the female coupling element 30 has a convex side 33 which is provided with the aforementioned socket 36 serving to receive the head 22 of the male coupling element 20 in such a way that the head 22 is reliably but releasably held in the element 30 as long as desired. The element 30 includes a centrally located cupped portion 37 which surrounds the socket 36, and the radially outwardly extending portion or collar 31 defining the inner side 34 and the outer side 33 of the element 30. The cupped portion 37 is formed with a centrally located opening 39 at the inner side 34, and this opening is in communication with the deepmost portion 35 of the socket 36.

The means for actually retaining the head 22 of the male coupling element 20 in the socket 36 comprises a suitably configurated (double S) spring 32 which is installed in stressed condition or is stressed as a result of penetration of the head 22 into the socket 36. The spring 32 reacts against the marginal zone of the collar 31 and its innermost portion or portions extend through apertures 38 which are provided in the central portion 37 close to the inner side 33 of the collar 31. The internal surface 66 of the central portion 37 is configurated to act as a stop for the head 22 of the male coupling element 20 when the latter is properly coupled with the female coupling element 30.

The purpose of the opening 39 in the central portion 37 of the female coupling element 30 is to permit entry of the projection 75 of the washer 70 as well as to permit entry of the open end 16' of end portion 18' of the hollow shank 12'. The dimensions of the recess 74 in the dome 71 are selected in such a way that the recess 74 can receive a substantial part of the central portion 37 including that part which defines the opening 39 so that the latter automatically receives the projection 75 when the portion 37 is introduced into the recess 74.

When the assembly of the female coupling element 30 and washer 70 into the unit 60' is completed, the unit 60' is ready to be assembled with the carrier 50' and rivet 10'. At such time, the annular portion 73 of the washer 70 is adjacent but need not actually contact the inner side 34 of the collar 31. Such contact is established as a result of penetration of the shank 12' through the carrier 50' and thereupon through the central portion of the dome 71 to enter the annular projection 75 (which then extends through the opening 39 of the central portion 37) and to be deformed in a manner as shown in FIG. 6. To this end, the press which is used to assemble the unit 60' with the rivet 10' employs a suitable upsetting tool which widens the open end 18' of the shank 12' and causes it to bias the projection 75 against the adjacent portion of internal surface 66 of the central portion 37 in order to establish a reliable fluidtight seal between the shank 12' and the central portion 37. At the same time, the plug 65 seals the interior of the shank 12' and the ring 64 sealingly engages the washer 70 as well as the adjacent side 51' of the carrier 50' around the hole 150'.

The material of the washer 70 is sufficiently elastic to yield while the central portion 37 of the female coupling element 30 is caused to enter the recess 74 so that the projection 75 finds its way into the opening 39 as a result of assembly of the element 30 and washer 70 into a unit 60'. The projection 75 is free to abruptly expand as soon as it has penetrated through the opening 39, and the projection is then ready to be deformed as a result of expansion of the end portion 18' of the hollow shank 12' of the washer 10'. Since it has a frustoconical shape, the properly inserted projection 75 tends to lie against or moves close to the adjacent portion of internal surface 66 of central portion 37 of the female coupling element 30. When received in the deepmost portion 35 of the socket 36, the projection 75 acts as a coupling which connects the parts 30, 70 of the unit 60' to each other preparatory to attachment of such unit to the carrier 50' and rivet 10'.

The machine in which the female component of the snap fastener is assembled includes means for maintaining successive rivets 10' in axial alignment with successive units 60' in such a way that the rivet 10' is adjacent the first or outer side 51' and the unit 60' is adjacent the second or inner side 52' of the carrier 50'. As the free end 16' of the end portion 18' of the shank 12' penetrates through the carrier 50' and thereupon through the dome 71 of the washer 70, it actually removes a disc-shaped portion 77 (FIG. 6) of the dome 71 and causes such disc-shaped portion to bear against the exposed side of the plug 65 in the internal space 15' of the shank 12'. A tool of the riveting press in which the female component of the snap fastener is being assembled expands the end portion 18' of the shank 12' in a manner as shown in FIG. 6, and the end portion 18' expands the projection 75 and urges this projection against the internal surface 66 of the central portion 37. This ensures complete sealing of the opening 39, partly by the washer 70 and its projection 75 and partly by the sealing means 63 (including the plug 65 and ring 64) in cooperation with the central portion 77 of the dome 71.

The central portion 77 can but need not remain in the internal space 15' of the deformed shank 12'. In other words, the sealing action of the central portion 77 is not crucial since the plug 65 completely fills a portion of the internal space 15' and thus prevents penetration of gaseous and/or hydraulic fluids (denoted by arrows 55 in FIG. 6) toward the insert 59 in the flange 78' of the rivet 10'.

The ring 64 cooperates with the washer 70 to establish a seal within as well as at both sides of the hole 150' in the carrier 50' to thus prevent the penetration of gaseous and/or hydraulic fluids from the outer side 51' to the inner side 52' of the carrier. The flange 78' of the applied rivet 10' is visible at the exposed outer side 51' of the carrier 50', and the socket 36 is accessible at the inner side 52' so that it can receive the head 22 of the male coupling element 20 which is located at the outer side 51 of the carrier 50.

The ring 64 cooperates (or can cooperate) with the dome 71 of the washer 70 to sealingly clamp or squeeze the carrier material around the hole 150' in order to even further reduce the likelihood of penetration of gaseous and/or hydraulic fluids through the hole 150' in a direction from the outer side 51' toward the inner side 52' of the carrier 50'. The ring 64 and the dome 71 then act not unlike two annular jaws which pinch the carrier material around the hole 150'. The plug 65 not only serves to prevent penetration of fluids into the flange 78' by way of the open end 16' of the shank 12' but also to intercept any fluids which might have entered the flange 78' at the marginal portion 57' of the cup 14'. The annular portion 73 of the deformed washer 70 bears against the inner side 34 of the collar 31 to further enhance the sealing action at the inner side 52' of the carrier 50' when the assembly and application of the female component of the snap fastener are completed. It can be said that the marginal portion 73 of the washer 70 constitutes a last barrier against penetration of fluids into the collar 31 whence the fluids could penetrate into the socket 36 by way of apertures 38 in the central portion 37 of the female coupling element 30.

Figure 7:
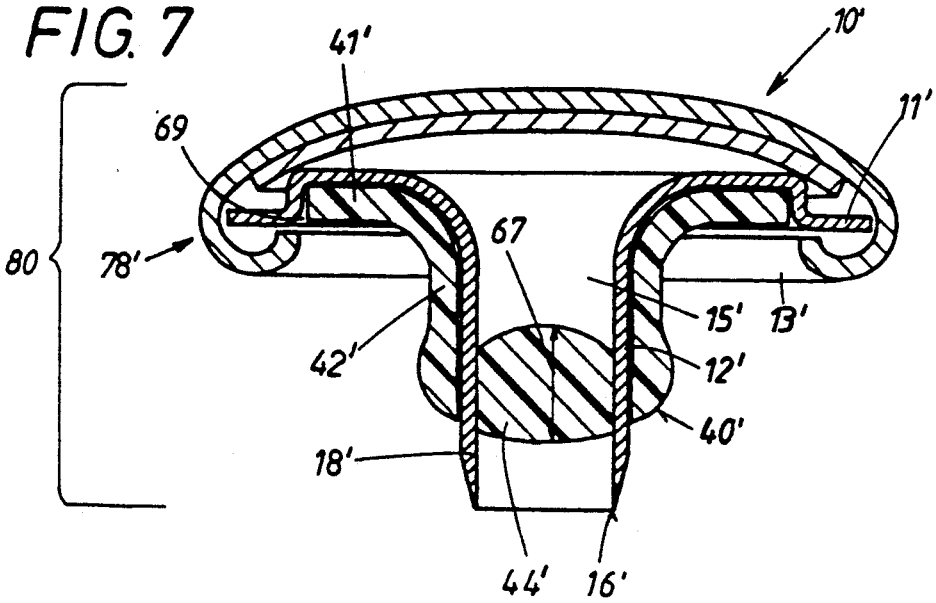
FIG. 7 is a central sectional view of a modified rivet which is part of the female component and carries the liner prior to insertion of its shank into the cavity of the male coupling element.

FIG. 7 shows a unit 80 including the rivet 10' and a liner 40' which latter can be used in lieu of the sealing means 63 of FIGS. 5 and 6. The liner 40' is a prefabricated part (i.e., its material need not be poured, sprayed or otherwise introduced into and around the shank 12' of the rivet 10') and is broken up into a plug 44' and a ring 42' as a result of piercing by the hollow shank 12' of the rivet 10'. The annular extension 41' of the pierced liner 40' fills the annular depression 69 in the adjacent side of the disc 11'. The free end 16' of the hollow shank 12' acts not unlike a ring-shaped cutter which separates the plug 44' from the ring 42' of the applied liner 40'. The reference character 67 denotes the (rather pronounced) thickness of the plug 44' in the internal space of the shank 12'; this plug reliably seals the internal space of the shank 12' adjacent the end portion 18' to prevent the flow of fluids into or from the flange 78' of the rivet 10'. The liner 40' can be said to constitute a sock which confines the shank 12' prior to penetration of the free end 16' into the liner, and such sock is then converted into the sealing members 42' and 44' as soon as the free end 16' is caused to penetrate through the rounded top wall which is thereby divided into the plug 44' and the adjacent portion of the ring 42'.

The manner in which the unit 80 of FIG. 7 is assembled with a female coupling element 30 and with a washer 70 is or can be the same as described with reference to FIG. 6. The members 44' and 42' of the subdivided liner 40' replace the plug 65 and the ring 64 of FIG. 6. Actually, the plug 44' replaces the plug 65 and the central portion 77 of FIG. 6.

An advantage of a snap fastener which embodies the unit 80 of FIG. 7 is that it can employ two identical liners one of which is used in a manner as described with reference to FIGS. 1 and 2 to form part of a unit 60 and the other of which is used in a manner as described with reference to FIG. 7 to yield a plug 44' and a ring 42'. Moreover, a snap fastener which employs two liners (40, 40') can dispense with the washer 70 of FIGS. 5 and 6.

Figure 8:
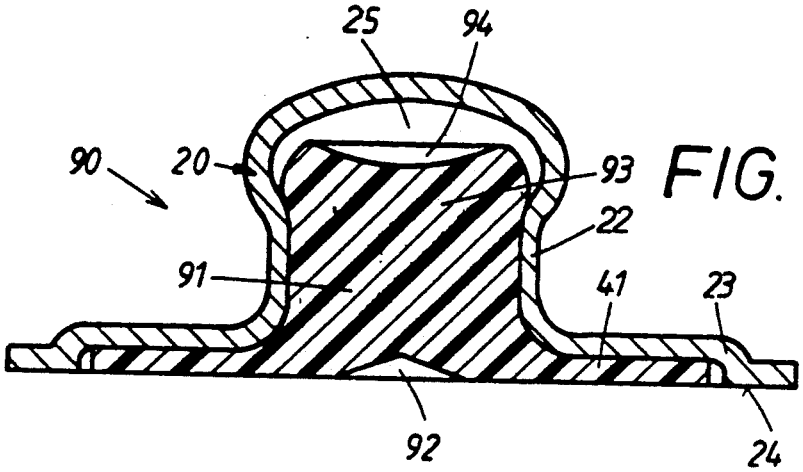
FIG. 8 is a central sectional view of a male coupling element of the type shown in FIGS. 1, 2 and 4, and a central sectional view of a different liner which is confined in the male coupling element.

FIG. 8 shows a unit 90 which can be utilized in lieu of the unit 60 of FIG. 2. The unit 90 employs a male coupling element 20 which is or can be identical with the similarly referenced male coupling element of FIGS. 1, 2 and 4, and a modified liner 91 which is formed with a rather shallow conical centering recess 92 for the free end 16 of a shank 12 and nearly completely fills the cavity 25 in the head 22 of the element 20 even before the cavity 25 receives the shank of a rivet. The liner 90 is made of an elastically deformable plastic material and has a surface 94 confronting the deepmost portion of the cavity 25. The surface 94 is provided with a shallow recess which is dimensioned in such a way that the cavity 25 is at least substantially filled with elastically deformable plastic material of the liner 91 when the unit 90 of FIG. 8 is assembled with a rivet 10, i.e., when the shank 12 of the rivet has been caused to penetrate into the recess 92 and thereupon into the protuberance 93 of the liner 91. The protuberance 93 is a solid stub which is in actual engagement with the adjacent portion of internal surface of the head 22, even before the cavity 25 receives the shank 12 of a rivet 10. The plastic material which is displaced as a result of penetration of a shank 12 into the cavity 25 entails a reduction of the unoccupied part of the cavity 25 and at least partial or even complete elimination of the recess in the surface 94 of the liner 91. The recess 92 at the inner side 24 of the collar 23 is designed to receive the pointed tip 16 of a shank 12 of the type shown in FIG. 2 but such recess can be modified or even left unchanged if the unit 90 of FIG. 8 is to be assembled with a modified rivet, e.g., with a rivet 10' or with a rivet 81 of the type shown in FIG. 9.

The deformed protuberance 93 of the liner 91 not only establishes a reliable mechanical connection between the shank 12 of a rivet 10 and the male coupling element 20 but such deformed protuberance also reliably prevents penetration of gaseous and/or hydraulic fluids into the cavity 25. The extension 41 of the liner 91 cooperates with the collar 23 of the male coupling element 20 and with the carrier 50 (not shown in FIG. 8) in the same way as described in connection with FIG. 4.

Figure 9:
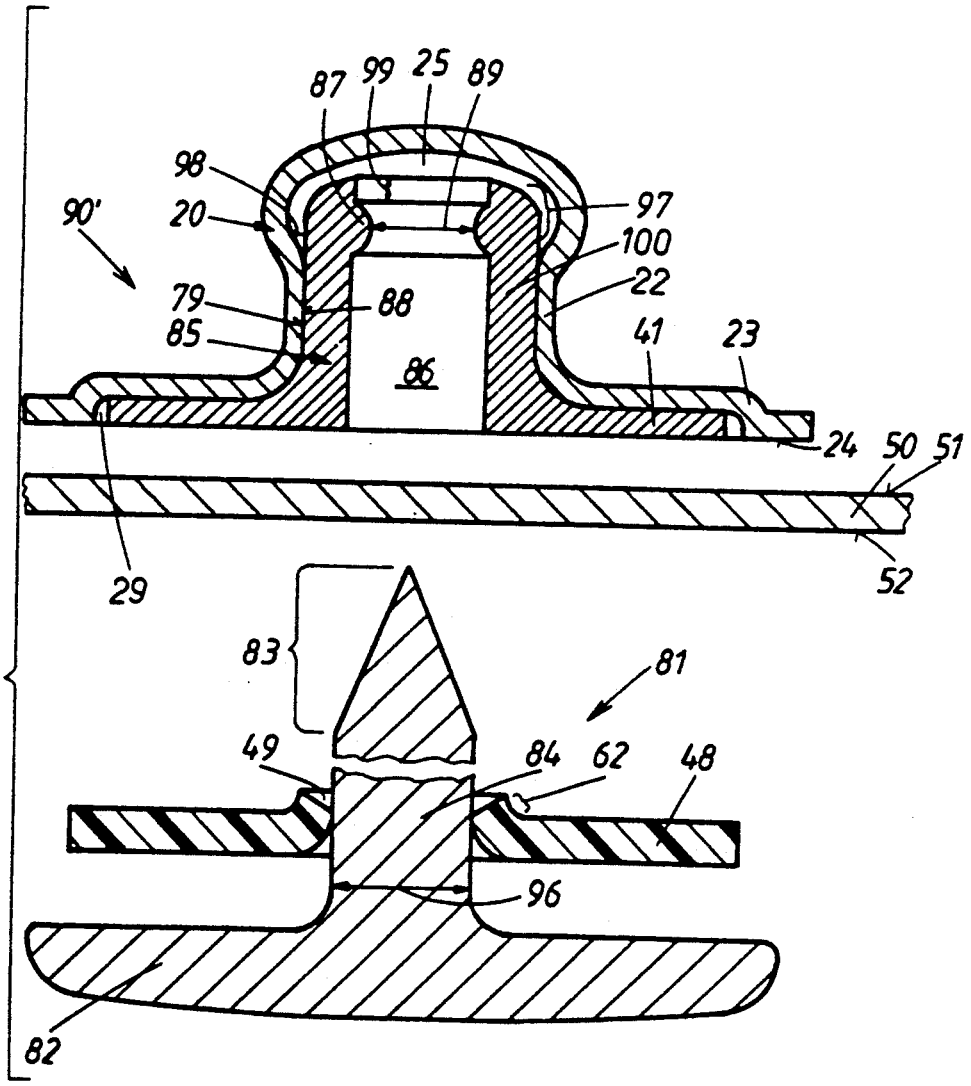
FIG. 9 is a view similar to that of FIG. 2 but showing a modified liner and a modified rivet which is to secure the male coupling element to one side of the first carrier.

FIG. 9 shows the parts of a modified male component which can be employed instead of the male component of FIG. 4. The unit 90' which is shown in the upper part of FIG. 9 employs a male coupling element 20 which is or which can be identical with the coupling element of FIG. 1, and a modified liner 85 which is made of a metallic material, particularly a ductile material such as aluminum or copper. The rivet 81 which is used to deform the metallic liner 85 and to connect the unit 90' to the outer side 51 of a carrier 50 is also different from the rivet 10; it is made of a single piece of metallic material and has a flange 82 and a solid shank 84 with a sharp conical end portion 83. The rivet 81 can be said to resemble a nail, particularly a thumbtack. The shank 84 is assembled with a washer 48 which is or can be identical with the similarly referenced washer of FIGS. 2 and 4.

The protuberance 100 of the liner 85 has a centrally located through passage 86 which extends all the way from the plane of the inner side 24 of the collar 23 to the deepmost portion of the cavity 25. The outer diameter of the protuberance 100 is selected in such a way that the latter fits into the cavity 25 without undergoing any appreciable deformation or without appreciably deforming the head 22 of the male coupling element 20. The insertion is terminated when the extension 41 is properly received in the depression 29 at the inner side 24 of the collar 23. The passage 86 includes an elongated portion which starts at the inlet of the cavity 25 and is bounded by a cylindrical internal surface of the liner 85, and a narrower portion with a smaller diameter 89 defined by an annular internal bead 87 of the protuberance 100. The diameter of the uppermost portion of the passage 86 (as seen in FIG. 9) equals or approximates the diameter of the major portion at the inlet of the cavity 25. The cylindrical external surface 88 of the protuberance 100 of the liner 85 is or can be a loose or a tight frictional fit in the adjacent neck of the head 22. The external surface 88 engages the internal surface 79 of the head 22. The diameter 89 is at least slightly smaller than the diameter 96 of the cylindrical main portion of the solid shank 84.

When the rivet 81 is in the process of causing its shank 84 to penetrate through the carrier 50 and thereupon into the passage 86 of the liner 85 in the head 22 of the male coupling element 20, the exposed surface of the extension 41 is at least substantially flush with the inner side 24 of the collar 23 and such exposed surface begins to bear upon the outer side 51 of the carrier 50 when the shank 84 penetrates into the passage 86 to a predetermined extent. As the shank 84 continues to enter the protuberance 100 of the liner 85, the flange 82 biases the deformable washer 48 against the inner side 52 of the carrier 50 to ensure that the carrier portion around the hole which is made by the shank 84 is reliably sealed by the extension 41 on the one hand and by the washer 48 on the other hand.

The sharp conical end portion 83 of the shank 84 penetrates through the carrier 50 on its way into the passage 86 and thereby pushes the carrier material around the thus obtained hole radially outwardly to thus promote the sealing engagement between the side 51 and the extension 41 as well as between the side 52 and the washer 48. When the end portion 83 of the advancing shank 84 enters the bead 87 of the liner 85 and strikes the internal surface of the head 22 (which is then propped from the outside), the end portion 83 undergoes pronounced deformation to ultimately resemble the cap of a mushroom. At the same time, the end portion 83 causes a radially outward deformation (spreading) of the free end portion 97 of the protuberance 100 of the liner 85 so that the end portion 97 expands into engagement with the internal surface 98 of the head 22 and thus establishes a reliable mechanical connection as well as a fluidtight connection between the shank 84 and the head 22. Thus, the end portion 83 is converted into a first rivet head which anchors the shank 84 in the protuberance 100 of the liner 85, and the end portion 97 of the protuberance 100 is converted into a second rivet head which anchors the liner 85 in the male coupling element 20. It has been found that the placing of the bead 87 at a certain distance (99) from the front end face of the protuberance 100 of the liner 85 contributes to the establishment of a more reliable connection between the shank 84 and the liner 85 as well as a more satisfactory radial expansion of the end portion 97 in the deepmost portion of the cavity 25.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A snap fastener comprising a male component including a male coupling element having an outer side, an inner side and a cavity with an inlet at said inner side, a first rivet having a deformable first shank extending into said cavity, and a liner at least a portion of which is disposed in said cavity between said male coupling element and said shank; and a female component including a female coupling element having a first side provided with a socket for said male coupling element and a second side provided with an opening in communication with said socket, a second rivet having a deformable hollow second shank extending into said socket by way of said opening, and sealing means including a plug in said second shank and a sealing ring surrounding said second shank.

2. The snap fastener of claim 1 for attachment to first and second carriers wherein the first carrier has a first side adjacent the inner side of said male coupling element and a second side and said liner has an annular extension abutting the first side of the first carrier, said first rivet having a flange abutting the second side of the first carrier, the second carrier having a first side adjacent the second side of said female coupling element and a second side and said second rivet having a flange at the second side of the second carrier, said first shank extending through the first carrier and said second shank extending through the second carrier.

3. The snap fastener of claim 2, wherein said liner has a recess for the shank of said first rivet and said hollow shank of said second rivet has an open end in said socket.

4. The snap fastener of claim 1, wherein said first rivet has a flange including a central portion integral with said first shank and said liner surrounds said first shank at least in the region of said central portion.

5. The snap fastener of claim 1, wherein said second rivet includes a flange rigid with said second shank and having a depression confronting an annular collar of said female coupling element, said sealing means having an annular extension at least partially filling said depression.

6. The snap fastener of claim 1, wherein said male coupling element includes a cupped portion which is receivable in said socket and a collar integral with said cupped portion, said inner and outer sides being provided on said collar and said inner side having an annular depression which surrounds and communicates with said inlet, said liner having an extension in said depression.

7. The snap fastener of claim 6, wherein said collar has a bent-over marginal portion which surrounds said depression.

8. The snap fastener of claim 6, wherein said depression has a predetermined depth and said extension has a thickness at least approximating said depth.

9. The snap fastener of claim 6, wherein said extension at least substantially fills said depression.

10. The snap fastener of claim 1, wherein said liner contains a solidified material.

11. The snap fastener of claim 1, wherein said plug contains a solidified material.

12. The snap fastener of claim 1, wherein said ring contains a solidified material.

13. The snap fastener of claim 1, wherein said liner contains an elastomeric material and includes a protuberance which is inserted into said cavity and is held in said male coupling element by snap action and by the shank of said first rivet.

14. The snap fastener of claim 1, wherein said first rivet comprises a flange which is rigid with said first shank, said flange having a side confronting said male coupling element and said side having a depression surrounding said first shank, and further comprising an annular elastic washer surrounding said first shank and at least partially filling said depression.

15. The snap fastener of claim 1, wherein said liner has a protuberance which at least partially surrounds the first shank in said cavity, said liner further having a washer-like extension integral with said protuberance and confined between a flange of said second rivet and a collar of said male coupling element, said extension surrounding said first shank.

16. The snap fastener of claim 15, wherein said protuberance includes a round top wall having a first thickness and an annular wall connecting said top wall with said extension and having a lesser second thickness.

17. The snap fastener of claim 16, wherein said male coupling element includes a ring-shaped constricting portion which surrounds a narrowed portion of said cavity at said inlet and has an inner diameter less than the diameter of said round top wall so that said top wall must undergo deformation during insertion into said cavity beyond said narrowed portion.

18. The snap fastener of claim 1, wherein said first shank is hollow and includes a pointed tip which undergoes deformation as a result of introduction into said cavity to thereby urge a portion of said liner against said male coupling element.

19. The snap fastener of claim 1, further comprising an elastic washer between said female coupling element and said second rivet, said washer having at least one projection extending by snap action into said socket by way of said opening and being outwardly adjacent said second shank.

20. The snap fastener of claim 19, wherein said washer includes a centrally located dome which is integral with said at least one projection and is traversed by said second shank.

21. The snap fastener of claim 20, wherein said washer has an omega-shaped cross-sectional outline, said dome having a recess at least partially conforming to and receiving a portion of said female coupling element, said at least one projection being provided in said recess.

22. The snap fastener of claim 1, wherein said liner contains a metallic material and said first shank is solid and includes a pointed end portion.

23. The snap fastener of claim 22, wherein said liner contains copper.

24. The snap fastener of claim 22, wherein said liner contains aluminum.

25. The snap fastener of claim 22, wherein said liner has a passage for said first shank and said passage includes a wider portion adjacent said inlet and a narrower portion remote from said inlet and having a diameter less than that of said first shank so that the liner undergoes deformation in the region of the second portion of said passage in response to forcible introduction of said first shank.

26. The snap fastener of claim 25, wherein said liner has an internal bead surrounding said narrower portion of said passage.

27. The snap fastener of claim 22, wherein said liner has a substantially cylindrical external surface which is a friction fit in the cavity of said male coupling element.

28. The snap fastener of claim 1, wherein said liner at least substantially fills said cavity prior and subsequent to introduction of said first shank into said cavity.

29. The snap fastener of claim 28, wherein said liner has a centering recess for said first shank in the region of said inner side.

30. The snap fastener of claim 28, wherein said liner has a surface facing away from said inlet and provided with a recess which at least partially disappears in response to introduction of said first shank into said cavity.

* * * * *